US005824137A

United States Patent [19]

Gutsch et al.

[11] Patent Number: 5,824,137

[45] Date of Patent: Oct. 20, 1998

[54] PROCESS AND APPARATUS TO TREAT GAS-BORNE PARTICLES

[76] Inventors: Andreas Gutsch, Seldeneckstrasse 16, D-76185 Karlsruhe; Friedrich Jacob Loffler, deceased, late of Karlsruhe; Elisabeth Löffler, Im Eichbäumle 28, 76139 Karlsruhe; Martin Löffler-Mang, Töpperstrasse 26, 76131 Karlsruhe; Walter Löffler, Ziegelbrunner Strasse 9, 70374 Stuttgart, all of Germany

[21] Appl. No.: 679,269

[22] Filed: Jul. 12, 1996

[30] Foreign Application Priority Data

Jan. 13, 1994 [DE] Germany ..... 44 00 827.9

[51] Int. Cl.[6] ..... B03C 3/41

[52] U.S. Cl. ..... 95/57; 95/78; 96/62; 96/97

[58] Field of Search ..... 96/96, 97, 60, 96/62; 95/57, 78, 79

[56] References Cited

U.S. PATENT DOCUMENTS

| | | | |
|---|---|---|---|
| 1,962,555 | 6/1934 | Deutsch | 96/82 X |
| 2,758,666 | 8/1956 | Prentiss | 96/97 X |
| 3,768,258 | 10/1973 | Smith et al. | 96/97 X |
| 3,826,063 | 7/1974 | Festner | 55/DIG. 25 |
| 4,071,688 | 1/1978 | Lynch et al. | 174/138 R |
| 4,391,614 | 7/1983 | Rozmus | 96/97 X |
| 4,477,263 | 10/1984 | Shaver et al. | 96/97 X |
| 4,670,026 | 6/1987 | Hoenig | 96/97 X |
| 4,734,105 | 3/1988 | Eliasson et al. | 55/338 X |

FOREIGN PATENT DOCUMENTS

| | | | |
|---|---|---|---|
| 1379191 | 10/1964 | France . | |
| 1407534 | 4/1969 | Germany . | |
| 2646798 | 4/1978 | Germany | 96/97 |
| 144509 | 10/1980 | Germany | 96/97 |
| 3737343A1 | 5/1988 | Germany . | |
| 53-64878 | 9/1978 | Japan . | |
| 3098658 | 4/1991 | Japan . | |

*Primary Examiner*—Richard L. Chiesa
*Attorney, Agent, or Firm*—Wood, Herron & Evans, L.L.P.

[57] ABSTRACT

An apparatus (10) to carry out a process, in particular for the electrically induced agglomeration of gas-borne particles, contains a closed flow duct (12) through which is directed an aerosol containing particles (14). For the purpose of the bipolar charging of the aerosol, at least one electrode pair (20, 22) is arranged in the flow duct (12), the electrode (20) being wired, so as to be ungrounded, to the negative pole of a current source, the strength of which is sufficient to produce a corona discharge between the electrodes (20 and 22). The electrodes (20 and 22) of each electrode pair are designed to be needle-shaped and are arranged to be insulated with respect to the flow duct walls, such that their tips (26) are disposed opposite each other. By use of the apparatus (10), it is possible to charge the aerosol which is directed through the flow duct (12) at least virtually symmetrically bipolarly, without any substantial particle deposition in the region of the electrodes (20) and (22) or in the flow duct (12).

27 Claims, 1 Drawing Sheet

PROCESS AND APPARATUS TO TREAT GAS-BORNE PARTICLES

This is a continuation of International Application PCT/EP95/00026, with an international filing date of Jan. 4, 1995, now abandoned.

FIELD OF THE INVENTION

The invention relates to a process for treating gas-borne particles, in particular for the electrically induced agglomeration of gas-borne particles, as well as to an apparatus for carrying out the process.

BACKGROUND OF THE INVENTION

Processes and apparatus for treating gas-borne particles have a wide operational range. They are used, in particular, in the field of the precipitation of particles, for the purpose of increasing the effectiveness of known particle precipitation processes and apparatus so as to include smaller and even the smallest particles. For example in the production of current from fossil fuels, in refuse incineration, in metallurgical high-temperature processes and in catalytic gas-solids syntheses, difficulties arise in the case of conventional particle precipitation techniques, since the size of the primary particles of the aerosols to be treated in the above-mentioned processes is, as a rule, distinctly less than 1 $\mu$m, and it is not possible, or at least not economically viable, for particles of this size to be precipitated applying conventional particle precipitation techniques.

If, however, a step is added before the actual particle precipitation operation, in which step the particles to be treated are agglomerated to form particle clusters, the results which can be achieved and are represented by the overall degree of precipitation are clearly improved, while the precipitation technique remains unchanged.

A further field of application is the solids synthesis from gas phase reactions. In the case of such syntheses, the size of the primary particles is frequently only a few nanometers. Already for economic reasons, an extremely effective particle precipitation is required in such instances, since the particles present in the aerosol constitute the substance of value to be extracted. Accordingly, within the framework of such solids syntheses, the increasing of the particle size prior to the actual particle precipitation is the primary objective, although the resultant structure of the agglomerate may be influenced by the agglomeration process selected.

Basically, the desired increasing of the particle size can be achieved in various ways. In addition to so-called "wet" processes, in which the particle-size increase is achieved by condensation of water vapour from a supersaturated atmosphere, agglomeration techniques, which are referred to as "dry" processes and in which the desired agglomeration is provided by a collision of the particles in a fluid phase, are also known. Accordingly, a prerequisite for this so-called direct agglomeration is that the individual particles in the fluid phase have a relative velocity amongst one another. This relative velocity can be provided by means of thermal and turbulent diffusion or by a particle movement induced by force fields. The force fields include, in particular, gravitational fields, centrifugal fields, sound fields or electric fields. The advantage of an electrically induced agglomeration, i.e. the production of relative velocities of the particles by means of an electric field, lies in the energy requirement which is considerably lower, for example in comparison to sound fields, in particular in the range of relatively small and smallest particles, where electric forces continue to exert a considerable influence on particle movements, while having a low energy requirement.

Electrostatic filters, in which a particle-loaded flow of gas, which is to be cleaned, is divided up into two component gas flows, which are spatially separated from each other, are known from DE 37 37 343 A1 and U.S. Pat. No. 3,826,063. Each component gas flow is charged unipolarly in the usual manner by at least one pair of electrodes. After the unipolar charging of the component gas flows, they are again brought together.

An electrostatic filter which comprises ionization electrodes and precipitation electrodes is known from DE OS 1 407 534 for the precipitation of particles from flows of gas. The ionization electrodes are designed as needle-shaped electrodes which are arranged opposite each other, while in each case two oppositely disposed ionization electrodes project into a hollow body which serves as the precipitation electrode. The desired precipitation of the particles is achieved due to a potential difference between the ionization electrodes and the precipitation electrode associated therewith, i.e. also in this arrangement, a unipolar charging of the particles takes place.

A process and an apparatus for the separation of solid or liquid particles from a flow of gas by means of an electric field are known from U.S. Pat. No. 4,734,105. In this regard, the particle-loaded gas flow is directed through a flow duct in which a plurality of planar flat or planar curved electrode pairs are arranged. At least the main electrodes are provided with needle-shaped extensions which project into the flow duct and have spherical or semi-spherical tips, at which a corona discharge and, thus, an ionization of gas molecules take place, once an electric field has been applied. In this regard, the spherical or semi-spherical tips of the needle-shaped electrode extensions have a diameter which is greater than the diameter of the shank of the needle. It is intended, by means of two secondary electrodes which are designed, for example, to be lattice-shaped, to ensure that the region in which the gas is ionized is separated in the radial direction from that region of the flow duct in which the particles, which are charged with the aid of the gas ions, collide. It is intended, in this manner, to permit the application of an intense electric field, which is intended to provide the solution to the problem set out in U.S. Pat. No. 4,734,105, namely to reduce, to a substantial extent, the path required in the direction of flow for the precipitation of the particles. Accordingly, the apparatus described in U.S. Pat. No. 4,734,105 is a further development of an electrostatic filter.

Accordingly, the basic concept of increasing the rate of collision of particles which are present in a flow of gas by applying an electric field, is known. It has, however, heretofore not been possible, with the aid of known methods of charging particles, to provide an at least substantially symmetrically bipolarly charged aerosol which is particularly desirable with a view to increasing the probability of collisions.

SUMMARY OF THE INVENTION

The invention is based on the object of providing a process and an apparatus to treat gas-borne particles, in particular for the electrically induced agglomeration of gas-borne particles, by means of which process and apparatus it is possible to provide an at least substantially symmetrically bipolarly charged aerosol and, at the same time, to minimize the deposition of particles during preparation.

According to the invention, this object is met by a process comprising the steps of directing a particle-laden flow of gas through a closed flow duct, and coupling into the flow duct via at least one electrode pair, an electric field which is suitable for the ionization of the gas flowing through the flow duct wherein the electrode pair includes needle-shaped electrodes of opposing polarity which are wired to be ungrounded and disposed radially opposite each other in the flow duct, thereby causing an agglomeration of the particles in the flow duct essentially in regions without an outside electric field.

Consequently, it has been recognized that it is necessary, for the successful bipolar charging of gas-borne solid or liquid particles, for all the electrodes to be designed to be needle-shaped and to be arranged such that the tips of each pair of electrodes are disposed opposite each other in the flow duct. The expression "needle-shaped" is not intended to restrict the electrodes used as far as their size is concerned, but is intended merely to characterize the electrodes with regard to their spike-like shape and their tip, the curvature diameter of which is smaller than the diameter of the electrode shaft.

In this regard, the electrodes must be wired such that they are ungrounded. In addition, it must be ensured that the electric field is coupled into the flow duct only via the needle-shaped electrodes, and that the flow duct is, otherwise, free of outside electric fields. As a result thereof, it is ensured that the electric field is coupled in in a spatially narrowly defined region, such that the agglomeration of particles takes place essentially in regions in which no outside electric field is present. In this manner, it is prevented that, in the case of an incomplete recombination of oppositely charged particles, a particle drift in a radial direction of the flow duct and, thus, a precipitation of particles in the flow duct take place. According to the invention, a spatial separation of the charging zones, i.e. a volumetric division of the flow, for the separate polarity-specific charging as is common in conventional processes and apparatus, is no longer required, as a result of which the precipitation of particles in the region of the charging zones is considerably reduced. In addition, as tests have shown, the absence of an outside electric field results in an increased rate of collision of the bipolarly charged aerosol and, thus, to a more effective agglomeration. In the process and apparatus according to the invention, the required wiring of the electrodes is also far simpler, due to the absence of additional secondary electrodes.

According to the process and apparatus according to the invention, coronas do not, as is the case in the prior art, burn between electrodes which are disposed on one and the same side of a flow duct, but rather between the tips of, in each case, two oppositely arranged electrodes. In addition to a reduction of the outlay in respect of the construction, this arrangement also results in that an electrostatic diffusion of identically charged gas ions takes place in the region of the needle tips, such that virtually the entire space of the flow duct is filled with charge carriers, although the electric field which serves for coupling-in is spatially very restricted. With the arrangement according to the invention, it is possible, for the first time, by applying an at least virtually symmetrical potential ratio at oppositely disposed electrodes, to charge virtually 100% of the gas-borne particles such that a virtually symmetrically bipolarly charged aerosol is provided. Consequently, it is now possible for super-fine aerosols, i.e. aerosols which contain particles essentially in the submicrometer range, i.e. particles smaller than 1 $\mu$m, preferably smaller than 0.5 $\mu$m and, in particular, smaller than 0.1 $\mu$m, to be agglomerated in an efficient manner.

In addition to being able to use conventional particle precipitation techniques even in respect of particles which were formerly not precipitatable in an economic manner, by first incorporating the process according to the invention or an apparatus according to the invention, it is now also possible to use the process according to the invention or to use an apparatus according to the invention within the framework of solids synthesis processes from gas phase reactions for the controlled influencing of the resulting agglomerates. With the aid of the electrically induced agglomeration, it is now possible, for example with regard to concentration, structure and dimension, to achieve, virtually in situ, specific agglomerate structures which differ clearly from these agglomerate structures such as they occur in diffusion-motivated agglomerations, i.e. agglomerations due to thermal and turbulent diffusion. Examples of application are currently found in glass fibre synthesis, $TiO_2$-pigment synthesis, the synthesis of matrix material $Al_2O_3$ for the chip industry, and in the semiconductor and superconductor synthesis.

It is seen from the above that the process according to the invention and the apparatus according to the invention are, in particular, suitable for the electrically induced agglomeration of small and smallest gas-borne particles, i.e. that it is even possible to agglomerate particles, the size of which falls in the nanometer range.

It has, however, also been found that the process according to the invention and the apparatus according to the invention are suitable to neutralize larger and highly unipolarly charged gas-borne particles. In this regard, larger particles are particles which are larger than approximately 1 to 2 $\mu$m and, in particular, larger than 5 $\mu$m. Measurements of the charge distribution in the particle-size range above about 1.5 $\mu$m have shown that, even here, with a bipolar wiring of the electrodes, a bipolarly charged aerosol is produced. It is, however, surprising that, in the case of these larger particles, the number of unit charges or elemental electron charges per particle is not significantly greater than in the case of substantially smaller particles which have been treated by the process according to the invention or by the apparatus according to the invention. On the basis of theoretical considerations, it was actually expected that the number of the unit charges would have to be approximately proportional to the particle size.

Accordingly, it is possible, according to the invention, for very highly unipolarly charged larger particles (about 500 to 1000 unit charges per particle) to be converted into a symmetrically bipolarly charged aerosol, each particle then having only about 20 or less unit charges. Such a value is considered as being virtually neutral in the case of the relevant larger particles (preferably larger than 2 $\mu$m and, in particular, larger than 5 $\mu$m). Although electrical interactions between the individual particles are still present, they do not affect the particle dynamics, due to the low mobility of the larger particles. This means that, with the aid of the process according to the invention and the apparatus according to the invention, problems such as occur in process installations as a result of the presence of highly charged and, in particular, highly unipolarly charged particles, are prevented. Examples of the problems referred to are: undesirable electric diffusion, deposits of particles on all types of walls, and the charging of the entire process installation and a resultant spark discharge on the installation.

In the case of smaller and the smallest particles, measurements have shown that the number of the electric unit charges per particle after the charging operation by means of the process according to the invention and the apparatus according to the invention is also in the region of 10 to 20. A higher charging is, however, not possible due to physical limits in the submicrometer region. Moreover, in the case of smaller and the smallest particles, the low number of unit charges mentioned is perfectly adequate to increase the rate of agglomeration, since smaller particles, in particular particles with a size in the nanometer region, have a very high mobility, for which reason even the smallest attracting interactions between the individual particles clearly influence particle dynamics.

A decisive advantage of the process according to the invention and of an apparatus according to the invention is to be found in the focussing effect of the needle-shaped electrodes, as a result of the opposing arrangement of which it is possible to generate oppositely charged particles in an immediate vicinity and in a spatially narrowly defined region, whereby the agglomeration rate is considerably increased in comparison to conventional processes and apparatus, and a precipitation of particles, in particular in the region of the corona electrodes, is greatly reduced.

The aerosol flowing through the flow duct is preferably repeatedly bipolarly charged in the direction of flow, in order to compensate for the charge recombination, which occurs during an agglomeration of oppositely charged particles, and to ensure a high collision rate. As a result of the repeated bipolar charging of the aerosol, it is also possible to influence the dimensions of the agglomerate in a controlled manner. Tests have shown that the step-by-step connection of additional pairs of electrodes results in an additional shift of the resultant particle size distribution into regions of greater particle sizes. A saturation of the agglomeration effect, owing to repeated bipolar charging of the aerosol, could not be established.

It has also been found that it is particularly advantageous for the region in which the electric field is coupled into the flow duct to be kept as small as possible. According to a preferred embodiment of an apparatus according to the invention, this is achieved in that the shaft of each electrode is surrounded by an electrical insulation, such that the region of generation of the charge is restricted to the tips of the needle-shaped electrodes.

The walls of the flow duct are preferably composed of electrically insulating plastics material or of a metal which is provided with an electrically insulating coating. In this manner, the focussing effect of the needle-shaped electrodes, with respect to the electric field, is still further increased.

The invention will be described in more detail hereinafter with reference to diagrammatic illustrations of an exemplified embodiment.

DETAILED DESCRIPTION OF THE PREFERRED EMBODIMENT

Figure 1:
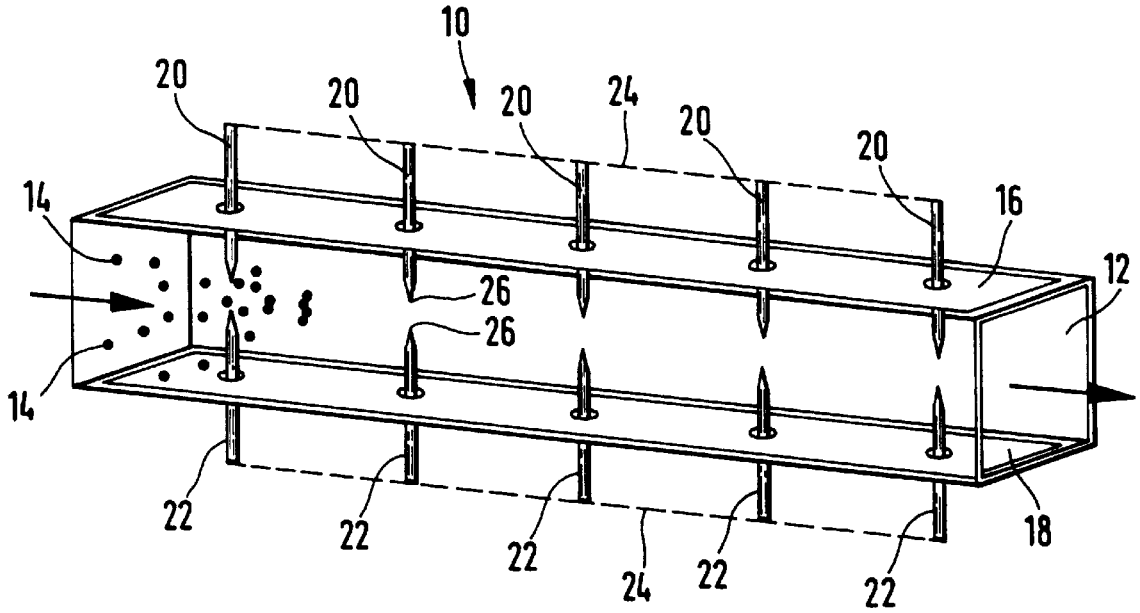
FIG. 1 is a partially opened-up perspective view of an apparatus according to the invention.

An arrangement 10 for the electrically induced agglomeration of gas-borne particles essentially comprises a closed flow duct 12 through which flows, in the direction of the arrow, an aerosol which contains gas-borne particles 14 which may be solid or liquid. The walls of the flow duct 12, i.e. the top surface 16, the bottom surface 18 and the two side faces, are composed of metal which is provided, on the inner side, with an electrically insulating coating. The walls may, however, equally well be composed of an electrically insulating plastics material. For the sake of greater clarity, that side face of the flow duct 12 which faces the viewer is illustrated as being transparent merely in the Figure.

Figure 2:
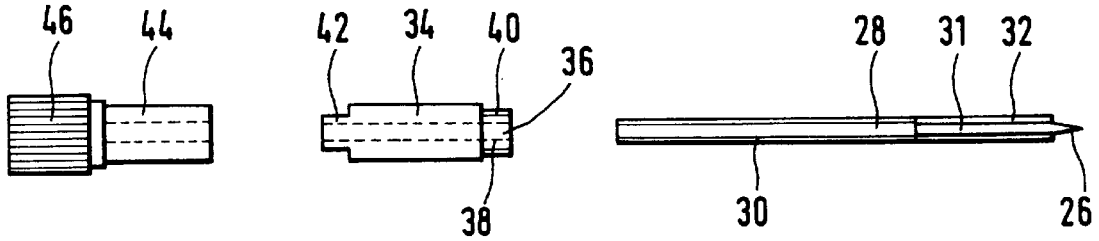
FIG. 2 shows a needle-shaped electrode, which is used in the apparatus according to FIG. 1, in an extended form.

Spike-like or needle-shaped electrodes 20, 22 are secured in the top surface 16 and the bottom surface 18 of the flow duct 12, which electrodes are electrically insulated with respect to said flow duct and pass through the surfaces 16 and 18 and extend therefrom at right angles into the flow duct 12, in each case, to the same extent. The electrodes 20 and 22, the structure of which is shown more clearly in FIG. 2, are connected, via an electric line 24, which is merely indicated in FIG. 1, to a source of high-voltage direct current, which is not illustrated, and are wired to be ungrounded, i.e. the top electrodes 20 in FIG. 1 are connected to the positive pole of the direct current voltage source, while the respective oppositely disposed bottom electrodes 22 are connected to the negative pole of the direct current voltage source. The term "ungrounded" is thus intended to signify that none of the electrodes 20 and 22 is earthed, but is rather actually connected to a positive and a negative potential, respectively. Instead of the source of direct current voltage, it is also possible to use a source of high-voltage alternating current.

One electrode 20 and one electrode 22 in each case form one electrode pair 20, 22, the tips 26 of which are disposed directly opposite each other with a spacing therebetween which may be in the region of at least about 10 mm up to about 40 mm. In the case of a very large flow duct, the spacing between the tips 26 may also be distinctly greater than 40 mm.

Five electrode pairs 20, 22 of this kind are arranged in the centre of the top surface 16 and the bottom surface 18, respectively, at a spacing of, in each case, 10 cm in the direction of flow. The spacing in the direction of flow of successive electrode pairs results from the residence time which particles 14 are intended to have between successive electrode pairs 20, 22, i.e. it depends on the geometry of the flow duct used and on the flow rate of the aerosol. It has been found that the residence time between electrode pairs 20, 22, which are arranged in succession in the direction of flow, is advantageously of the order of one second.

By applying the source of direct current voltage in the manner described, an electric potential is made available to the oppositely disposed tips 26 of the electrodes 20 and 22, which potential is sufficient to produce a stable corona discharge at each tip 26. To this end, field strengths of about 2,000 V/cm are required. If the spacing between the tips 26 of an electrode pair 20, 22 is, for example, 20 mm, a voltage of about 4,000 V must, however, be applied to the electrodes 20 and 22.

The locally very high electric field strengths, which are produced due to the coronas which burn in a stable manner between the tips 26, cause the ionization of the carrier gas. The thus produced gas ions and the free electrons, due to a collision with the gas-borne particles, subsequently bring about the charging of said particles. In this regard, the potential relationship between the electrodes 20 and 22 is set such that a substantially symmetrical bipolar charging of the aerosol, which is directed through the flow duct 12, takes place. The agglomeration of the charged particles in part already takes place in the region of the charging zone, i.e. between the electrodes 20 and 22, but takes place essentially immediately downstream. No outside electric field is present beyond the charging zones due to the electric field which is heavily focussed by the tips 26 and due to the electrodes 20 and 22 which are electrically insulated with respect to the flow duct 12.

The five electrode pairs 20, 22 ensure that the agglomeration of oppositely charged particles taking place during the residence time of the aerosol in the flow duct 12 and the resultant charging recombination, which causes a reduction of the attractive interaction potential within the particle collection, is balanced out and is overcompensated for, and a high collision rate is thus maintained along the entire length of the flow duct 12. With a controlled overcompensation, it is possible to influence the resultant dimension of the agglomerate, with a view to an increase thereof, by the repeated bipolar charging of the aerosol.

FIG. 2 shows the structure of a needle-shaped electrode 20 and its mounting in the top surface 16 in more detail. The electrodes 22 have the same structure and are mounted in the same manner in the bottom surface 18 of the flow duct 12.

The core of the electrode 20 is a thin long special steel needle 28, and the tip 26 is formed on its inner end, relative to the flow duct 12. An outside screw thread 30 is provided on the greater part of the special steel needle 28. That part of the needle shaft 31 which, in the ready-for-use state, projects into the flow duct 12 is surrounded by an electrical insulation 32 which leaves clear only the tip 26 and thus extends from the shaft-sided end of the tip 26 up to the commencement of the outside thread 30.

Via its outside screw thread 30, the special steel needle 28 is screwed into a brass sleeve 34 which, for that purpose, is provided with a continuous bore 36 having a matching inside screw thread 38. At its end facing the flow duct 12, the brass sleeve 34 is provided with an outside thread 40, via which it can be screwed into the top surface 16 in which a hole, having a corresponding inside thread, is provided. A connection 42 for an open-jawed or ring spanner is provided at that end of the brass sleeve 34 which faces away from the flow duct, in order to facilitate the screwing-in operation.

The electrical connection of the electrode 20 is provided by means of a further sleeve 44, which also has a continuous bore which is provided with an inside screw thread which matches the outside screw thread 30 of the special steel needle 28. This sleeve 44 which is connected to the line 24, which is not illustrated in the present instance, is screwed on that part of the outside thread 30 which projects outwardly from the brass sleeve 34. Reference number 46 designates a handle member which is mounted on the sleeve 44 and simultaneously serves for electrical insulation.

What is claimed is:

1. Process for treating gas-borne particles for the electrically induced agglomeration of such particles, comprising the following steps:

directing a particle-laden flow of gas through a closed elongated flow duct, and coupling into the flow duct an electric field which is suitable for the ionization of the gas flowing through the flow duct via at least one pair of needle-shaped ungrounded electrodes having opposite polarity, the electrodes of each electrode pair being disposed radially opposite each other in the flow duct with no structure residing therebetween along the length of the duct occupied by the electrodes, the electrodes being spaced an effective distance such that ionization of the gas takes place between the electrodes, causing an agglomeration of the particles in the flow duct during flow therethrough.

2. Process according to claim 1, wherein the particles are substantially symmetrically charged.

3. Process according to claim 1, wherein the particles are repeatedly bipolarly charged in the direction of flow.

4. Process according to claim 1, wherein the particles are charged in a direct current voltage field.

5. Process according to claim 1, wherein the electric field is focussed in a spatially very narrowly defined region between the tips of the needle-shaped electrodes.

6. Process according to claim 1, wherein at least some of the particles to be charged are smaller than 0.1 $\mu$m.

7. A method according to claim 1, whereby the gasborne particles are highly unipolarly charged, thereby to neutralize the highly unipolarly oppositely charged, gas-borne particles.

8. The method according to claim 1, wherein at least some of the particles are larger than 1.5 $\mu$m.

9. The method of claim 1 wherein the strength of the electric field is about 2,000 volts/cm.

10. The method of claim 1 wherein the distance between the needle-shaped electrodes is in the range of about 10 mm to 40 mm.

11. The method of claim 1 wherein the agglomerated particles are titanium dioxide ($TiO_2$).

12. The method of claim 1 wherein the agglomerated particles are pyrogenic oxides usable in the glass fibre or semiconductor industry.

13. The method of claim 1 wherein the particles are aluminum dioxide ($Al_2O_3$).

14. The method of claim 1 wherein there is in the elongated flow duct essentially no electric field other than the electric field generated between the pair of radially opposing electrodes.

15. Apparatus for electrically inducing agglomeration of gas-borne particles, comprising:

a closed and elongated flow duct (12), a plurality of needle-shaped electrodes (20, 22) arranged in pairs in the flow duct (12), the electrodes being arranged in pairs radially opposite each other in the flow duct (12), the electrodes being insulated with respect to the walls of the flow duct and wired so as to be ungrounded, the electrodes of each said pair having opposite polarity and having no structure residing therebetween along the length of the duct occupied by the electrodes, and a current source connected to the electrodes, the current source having a strength sufficient to produce corona discharges between the electrodes of each said pair so that ionization of the gas takes place between the electrodes, causing an agglomeration of the particles in the flow duct during flow therethrough.

16. Apparatus according to claim 15, wherein the potential ratio applied to oppositely disposed electrodes (20 and 22) is at least substantially symmetrical.

17. Apparatus according to claim 15 further comprising a plurality of electrode pairs (20, 22) arranged in succession in the flow duct (12).

18. Apparatus according to claim 17 wherein the electrode pairs (20, 22) are arranged in the flow direction with a spacing therebetween of at least approximately 10 cm.

19. Apparatus according to claim 15 wherein the current source is a source of high-voltage direct current.

20. Apparatus according to claim 15 wherein each electrode (20 and 22) includes a needle shaft (31) which is surrounded by an electrical insulation (32).

21. Apparatus according to claim 15 wherein each pair of electrodes includes two oppositely disposed tips (26) spaced from each other by about 10 mm to 40 mm.

22. Apparatus according to claim 15 wherein each of the electrodes (20 and 22) is secured in the duct wall by two sleeves (34, 44).

23. Apparatus according to claim 15 wherein the duct wall is made of electrically insulating plastics material.

24. Apparatus according to claim 15 wherein the duct wall is made of metal and is provided on the inside with an electrically insulating coating.

25. The apparatus of claim 15 wherein the strength of the electric field is about 2,000 volts/cm.

26. The apparatus of claim 15 wherein the distance between the needle-shaped electrodes is in the range of about 10 mm to 40 mm.

27. The apparatus of claim 15 wherein there is in the elongated flow duct essentially no electric field other than the electric fields generated by the pairs of opposing needle-shaped electrodes.

* * * * *